US005585611A

United States Patent [19]

Harvey et al.

[11] Patent Number: 5,585,611

[45] Date of Patent: Dec. 17, 1996

[54] INTERRUPTER ASSEMBLY

[75] Inventors: Ian J. Harvey, Bloomington; Lexie W. Crowe, Bloomfield, both of Ind.; Keith E. Lindsey, La Canada Flintridge, Calif.

[73] Assignee: ABB Power T&D Company Inc., Raleigh, N.C.

[21] Appl. No.: 221,102

[22] Filed: Mar. 31, 1994

(Under 37 CFR 1.47)

[51] Int. Cl.[6] ..... H01H 33/00

[52] U.S. Cl. ..... 218/155; 218/139; 218/134

[58] Field of Search ..... 218/118, 121, 218/134, 138, 139, 155; 361/2, 5–7, 79, 90–93

[56] References Cited

U.S. PATENT DOCUMENTS

| | | | |
|---|---|---|---|
| 2,706,742 | 4/1955 | Ehlers | 174/52 |
| 3,812,314 | 5/1974 | Nonken | 200/144 |
| 4,037,187 | 7/1977 | Himi | 337/121 |
| 4,123,618 | 10/1978 | Cushing et al. | 174/11 |
| 4,210,774 | 7/1980 | Perry | 174/140 |
| 4,241,373 | 12/1980 | Mara et al. | 361/92 |
| 4,267,402 | 5/1981 | Reighter | 174/137 |
| 4,823,022 | 4/1989 | Lindsey | 307/149 |
| 4,827,370 | 5/1989 | St-Jean | 361/127 |
| 4,989,115 | 1/1991 | Bourdages | 361/126 |

FOREIGN PATENT DOCUMENTS

0580285A2 1/1994 European Pat. Off. .

OTHER PUBLICATIONS

Brochure, Joslyn Mfg. and Supply Co., "Joslyn VBM Fault Interrupter", pp. 1–12, (Jan. 1984).

*Primary Examiner*—Brian W. Brown
*Assistant Examiner*—Michael A. Friedhofer
*Attorney, Agent, or Firm*—Woodcock Washburn Kurtz MacKiewicz & Norris

[57] ABSTRACT

An interrupter assembly comprises an interrupter switch and at least one condition sensing device embedded within a body of solid dielectric material. Preferably, the solid dielectric material is a polymer concrete or an epoxy-concrete. The condition sensing device may comprise a current sensor and/or a voltage sensor.

14 Claims, 4 Drawing Sheets

INTERRUPTER ASSEMBLY

BACKGROUND OF THE INVENTION

1. Field of the Invention

The present invention relates generally to interrupter devices for high voltage AC distribution systems, and more particularly, to an interrupter assembly comprising an interrupter switch and a condition sensing device, wherein the interrupter assembly and condition sensing device are each embedded in a solid dielectric material.

2. Description of the Prior Art

Vacuum interrupters or switches are employed in many high voltage applications to perform various interrupting and switching functions. For example, vacuum interrupters are used in reclosers, circuit breakers, intelligent switches for automated power distribution, and indoor switchgear. A typical vacuum interrupter comprises a pair of large-surface electrical contacts arranged in an axial configuration and enclosed within an evacuated metal-ceramic housing. One of the contacts is stationary, while the other moves in an axial direction to open and close the contacts.

In many applications, a number of vacuum interrupters are housed in a single enclosure along with related circuit components. For example, current and/or voltage sensors may be included to provide input to overcurrent protective relays, measuring devices and monitoring relay schemes in the control function of the equipment. Typically, the enclosures are filled with an insulating oil or gas (e.g. $SF_6$) having a high dielectric strength to provide electrical insulation between the vacuum interrupters and other components. Immersing the interrupters and associated sensing devices in an insulating oil or gas allows the individual assemblies to be mounted in closer proximity, thus reducing the overall size and cost of the equipment. In some cases, however, the current and voltage sensing devices are mounted separately from the vacuum interrupters to further isolate these components. Unfortunately, use of insulating oils or gases makes maintenance of the equipment more difficult and often requires special handling equipment. Additionally, there is a growing environmental concern with respect to a number of oil and gas compositions currently employed in the high voltage equipment industry.

Recently, the electrical utility industry has been exploring the use of polymer concrete and similar dielectric materials as a replacement for porcelain in a wide variety of insulating applications. Polymer concretes are composite materials consisting of inorganic aggregates, such as silica, bonded together with a low viscosity organic resin. The most widely known polymer concrete formulations have been trademarked by the Electric Power Research Institute under the trade name Polysil. Polymer concretes are mechanically strong and have excellent electrical properties, including a Dielectric Strength in the range of 400 V/mil. Additionally, polymer concretes can be easily molded or cast into complex shapes. Epoxy-concrete is a similar solid dielectric material wherein epoxy is used to bond the silica aggregates. Various epoxy resins which do not contain silica aggregates, such as cycloaliphatic epoxy resin, also provide similar properties.

Nonken, U.S. Pat. No. 3,812,314, discloses an interrupter assembly for use in underground electric power distribution systems that comprises a vacuum interrupter switch embedded in a bushing formed of electrically insulated epoxy resin. However, Nonken does not teach or suggest encapsulating other devices, such as current or voltage sensors, within the bushing to create a single multi-function assembly.

Reighter, U.S. Pat. No. 4,267,402, discloses an insulator formed of polymer concrete that has mounting threads molded directly into the polymer concrete. St-Jean et al., U.S. Pat. No. 4,827,370 discloses a cylindrical enclosure formed of epoxy-concrete or polymeric concrete for housing a surge arrester. Lindsey, U.S. Pat. No. 4,823,022, discloses a power line insulator formed of Polysil. A voltage sensor, current sensor and terminal box are embedded in the Polysil during the molding process for the insulator.

Although Nonken teaches embedding a vacuum interrupter in an epoxy resin and Lindsey teaches embedding voltage and current sensing devices in a power line insulator formed of Polysil, the prior art has not recognized the reduced size, ease of maintenance and environmental advantages of combining a vacuum interrupter and current/voltage sensing devices in a single cast/molded interrupter assembly formed of polymer concrete or a similar solid dielectric material. Such assemblies would eliminate the need for an insulating oil or gas and would allow reduced spacing between adjacent interrupter assemblies in a wide variety of high voltage equipment. By incorporating a current and/or voltage sensing device in the solid dielectric material, the need to mount these devices separately or provide additional insulation would be eliminated.

SUMMARY OF THE INVENTION

The present invention is directed to an interrupter assembly comprising an interrupter switch and at least one condition sensing device operatively coupled to the interrupter switch for sensing a condition of a circuit to which the interrupter assembly is connected, wherein the interrupter switch and the condition sensing device are each embedded in a solid dielectric material. In one embodiment, the interrupter switch is embedded in a first body of solid dielectric material and the condition sensing device is embedded in a second body of solid dielectric material. The first and second bodies are then joined together to form a single assembly. In another embodiment, the interrupter switch and the condition sensing device are embedded within a single body of solid dielectric material.

Preferably, the solid dielectric material is one of a polymer concrete, an epoxy-concrete or an epoxy resin. The condition sensing device may comprise a current sensor and/or a voltage sensor. Other current sensing devices may also be embedded in the solid dielectric material. The interrupter switch may comprise a vacuum interrupter switch having a stationary terminal rod and a movable terminal rod. Preferably, a substantially cylindrical opening is formed in the solid dielectric material about the movable terminal rod to allow axial movement of the movable terminal rod within the interrupter assembly.

Other features and advantages of the present invention will become evident hereinafter.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings, embodiments that are preferred, it being understood, however, that the invention is not limited to the specific methods and instrumentalities disclosed. In the drawings.

DESCRIPTION OF THE PREFERRED EMBODIMENT

Figure 1:
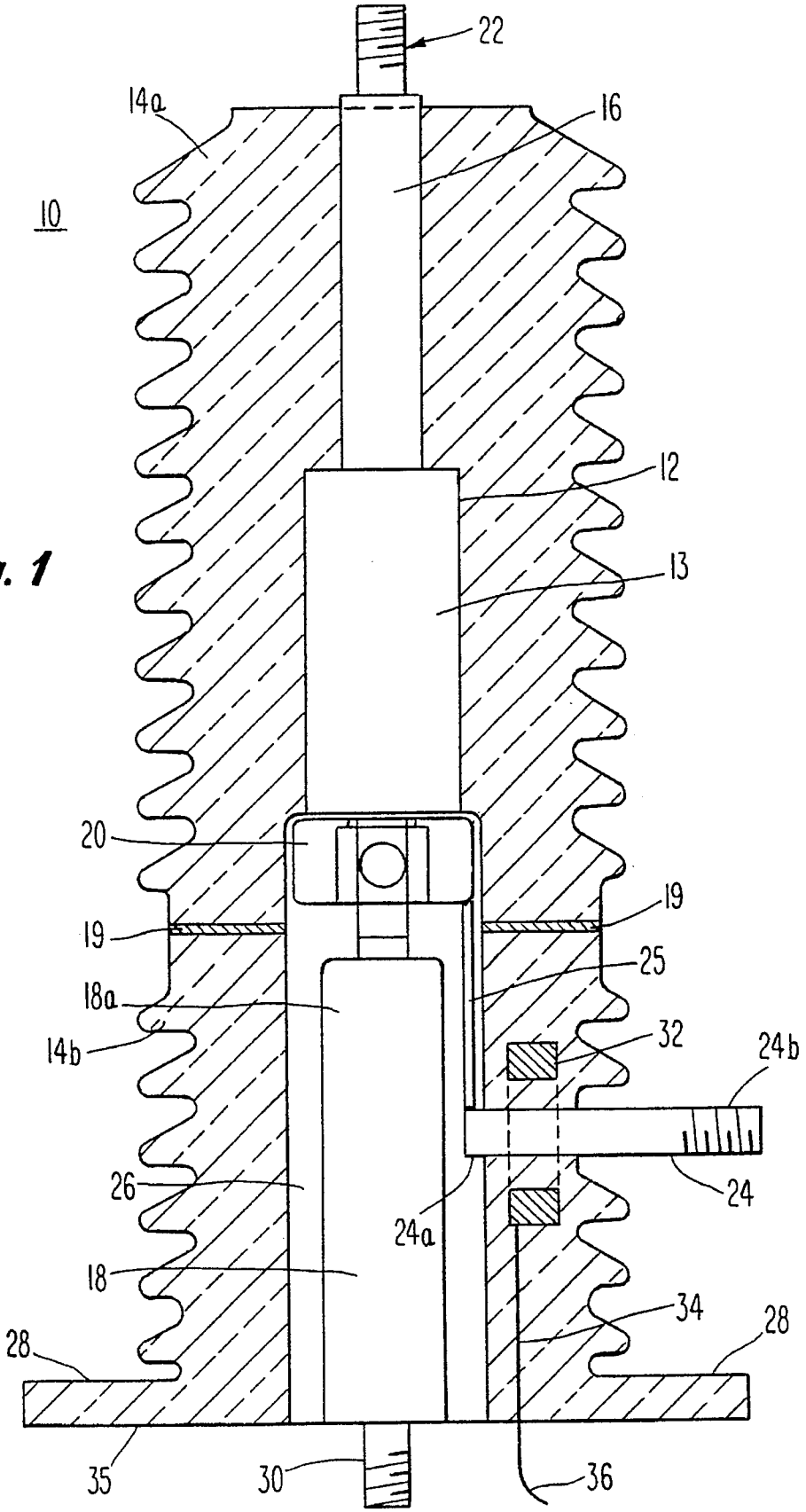
FIG. 1 is a sectional view of an interrupter assembly in accordance with a first embodiment of the present invention.

Referring to the drawings wherein like numerals indicate like elements throughout, there is shown in FIG. 1 an interrupter assembly 10 in accordance with a first embodiment of the present invention. As shown, in the first embodiment, the interrupter assembly 10 comprises an interrupter switch 12 and a condition sensing device 32, each of which is embedded within a solid dielectric material. The interrupter switch 12 being embedded in a first or an upper portion of the solid dielectric material and the condition sensing device being embedded in a second or a lower portion of the solid dielectric material. In the first embodiment, the interrupter switch 12 is substantially embedded within a first body 14*a* of solid dielectric material, and the condition sensing device 32 is embedded within a second body 14*b* of solid dielectric material. The first and second bodies 14*a*, 14*b* are joined together to form a single assembly. Any suitable means may be employed to join the first and second bodies 14*a*, 14*b*. For example, the first and second bodies 14*a*, 14*b* may be joined together with an adhesive or glue. Alternatively, the first and second bodies 14*a*, 14*b* may be bolted together. Preferably, a sealing compound or gasket material 19 is provided between the first and second bodies 14*a*, 14*b* to prevent moisture and other impurities from leaking through the joint.

Preferably, the first and second bodies of solid dielectric material 14*a*, 14*b* are each formed of a polymer concrete. As explained above, polymer concretes are composite materials consisting of inorganic aggregates, such as silica, bonded together with a low viscosity organic resin. The most widely known polymer concrete formulations have been trademarked by the Electric Power Research Institute under the trade name Polysil. Polymer concretes are mechanically strong and have excellent electrical properties, including a Dielectric Strength in the range of 400 V/mil. While polymer concrete is the preferred material, any other solid dielectric material having similar properties may be employed without deviating from the spirit and scope of the present invention. For example, an epoxy concrete could be used. Alternatively, an epoxy resin without silica aggregates, such as cycloaliphatic epoxy resin, could be used. Cycloaliphatic epoxy resin has a Dielectric Strength of about 350 V/mil.

The interrupter switch 12 and condition sensing device 32 are embedded within the respective solid dielectric bodies 14*a*, 14*b* during suitable molding operations. The overall size and shape of each solid dielectric body 14*a*, 14*b* is not limited to that illustrated in FIG. 1. Rather, the solid dielectric bodies 14*a*, 14*b* may be molded to any desired shape, thereby providing great flexibility in the design of electrical equipment incorporating such assemblies. Projections 28 may be formed on the second body 14*b* to facilitate clamping of the assembly to electrical equipment (not shown). Additionally, threaded metal inserts (not shown) may be embedded in the bottom 35 of solid dielectric body 14*b* for securing the assembly with suitable hardware.

In the present embodiment, the interrupter switch 12 is a vacuum interrupter switch that comprises a pair of large-surface electrical contacts (not shown) disposed within an evacuated housing 15. A stationary terminal rod 16 extends from one end of the housing 15 and emerges from the solid dielectric body 14 to form an upper contact terminal 22. A movable terminal rod 18, sometimes also referred to herein as an "operating rod", extends from the other end of the housing 15 through a substantially cylindrical opening 26 formed in the second body 14*b* of solid dielectric material. The cylindrical opening 26 is formed in the second body 14*b* to allow axial movement of the operating rod 18. The distal end 30 of the operating rod 18 may be connected to a suitable operating mechanism (not shown) for opening and closing the contacts (not shown) of the interrupter switch 12. A contact over-travel spring (not shown) may be provided in either the top end 18*a* or bottom end 18*b* of the operating rod; the top end 18*a* has been found to be a preferable location for the contact over-travel spring (not shown).

A current transfer assembly 20 is coupled about the proximal end of the operating rod 18. A lower contact terminal 24 is embedded in the second body 14*b* of dielectric material such that one end 24*a* is disposed in the cylindrical opening 26 while the other end 24*b* protrudes outward from the side of the solid dielectric body 14*b*. An electrical connection 25 is provided between the current transfer assembly 20 and the lower contact terminal 24. The current transfer assembly 20 operates to transfer current flow from the movable terminal rod 18 to the lower contact terminal 24 and may comprise a roller contact, sliding contact, flexible connector or other suitable device.

When the interrupter assembly 10 is connected to an electrical circuit (not shown), the condition sensing device 32 operates to sense a condition of that circuit. In the present embodiment, the condition sensing device comprises a current sensor 32 that is operatively coupled to the lower contact terminal 24 for measuring the magnitude of current flow in the circuit. Preferably, the current sensing device 32 comprises a ring-type current transformer having its secondary winding wrapped about an annular core. As illustrated in FIG. 1, the current transformer 32 is embedded within the second body 14*b* of solid dielectric material such that the contact terminal 24 extends axially through the center of the annular core. In this configuration, the contact terminal 24 serves as a single-turn primary of the transformer 32. A lead 34 of the secondary winding of the current transformer runs through the solid dielectric body 14*b* and emerges from the bottom end 35 of the assembly 10. The end 36 of the secondary lead 34 can be connected to an over-current protection device, a measuring device or a monitoring relay scheme in the control function of an electrical apparatus employing the interrupter assembly 10 of the present invention. Although a ring-type current transformer is preferred, any suitable current sensing device may be employed.

Figure 2:
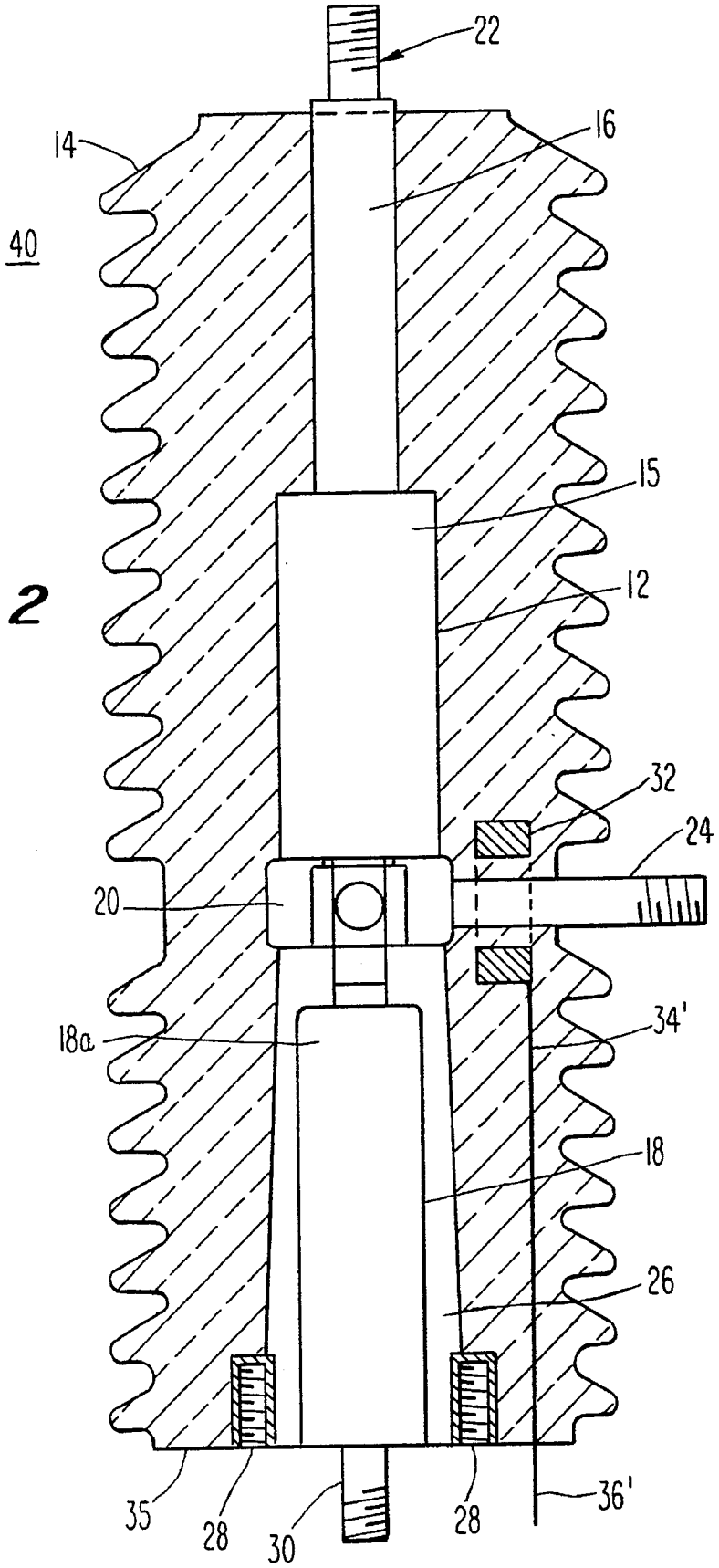
FIG. 2 is a sectional view of an interrupter assembly in accordance with a second embodiment of the present invention.

FIG. 2 illustrates an interrupter assembly 40 in accordance with a second embodiment of the present invention. As shown, in the second embodiment, the interrupter switch 12 and the condition sensing device 32 are both embedded within a single body 14 of solid dielectric material during a suitable molding operation. As in the first embodiment of the invention, the interrupter switch is embedded in a first or the upper portion of the solid dielectric material and the condition sensing device 32 is embedded in a second or the lower portion of the solid dielectric material. As can be appreciated, the overall size and shape of the solid dielectric body 14 is not limited to that illustrated in FIG. 2. Rather, the solid dielectric body 14 may be molded to any desired shape. As further shown in FIG. 2, in the second embodiment, the lower contact terminal is connected directly to the current transfer assembly 20. The condition sensing device 32 again comprises a current sensor.

As in the first embodiment, a stationary terminal rod 16 of the interrupter switch 12 extends from one end of the housing 15 and emerges from the solid dielectric body 14 to form an upper contact terminal 22. A movable terminal rod or "operating rod" 18 extends from the other end of the housing 15 through a substantially cylindrical opening 26 formed in the body 14 of solid dielectric material during the molding operation. As in the first embodiment, the cylindrical opening 26 is formed in the solid dielectric body 14 to allow axial movement of the operating rod 18.

As in the first embodiment, the body 14 of solid dielectric material is preferably formed of a polymer concrete. However, any other suitable solid dielectric material can be employed. For example, an epoxy concrete or an epoxy resin, such as cycloaliphatic epoxy resin, can be employed. Mounting threads 28 may be formed in the solid dielectric body 14 to facilitate mounting of the assembly 10 to electrical equipment (not shown). Alternatively, projections (not shown) can be formed at the base of the assembly to facilitate clamping of the device to an electrical apparatus, as in the first embodiment.

Figure 3:
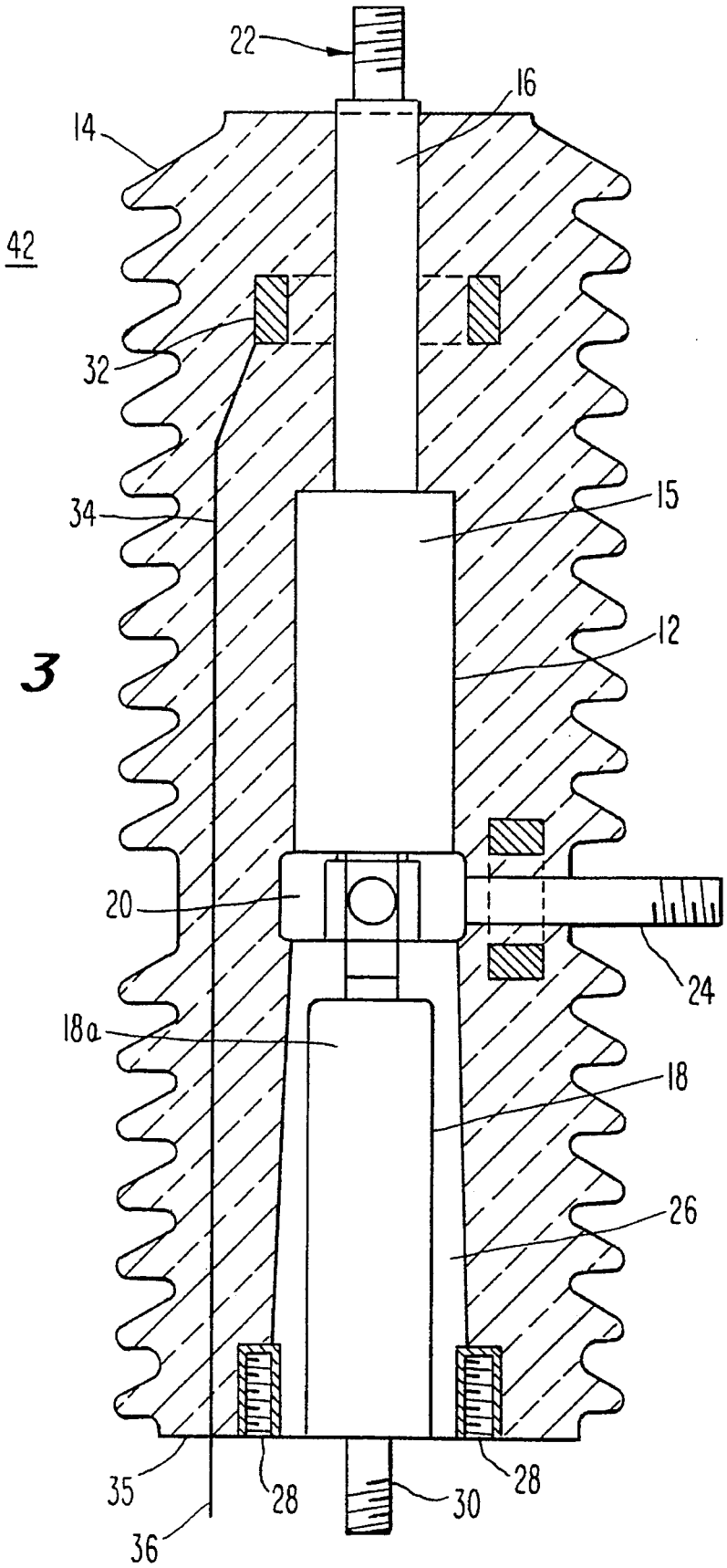
FIG. 3 is a sectional view of an interrupter assembly in accordance with a third embodiment of the present invention.

FIG. 3 illustrates an interrupter assembly 42 in accordance with a third embodiment of the present invention. As shown, the third embodiment is identical to the second embodiment except that the condition sensing device 32 is embedded in the solid dielectric body 14 so as to be operatively coupled about the stationary terminal rod 16 of the interrupted switch 12. Positioning the condition sensing device 32 about the stationary terminal rod 16 provides a more symmetrical assembly. The increased symmetry makes it easier to mold the solid dielectric material about the interrupter switch 12 and condition sensing device 32.

Figure 4:
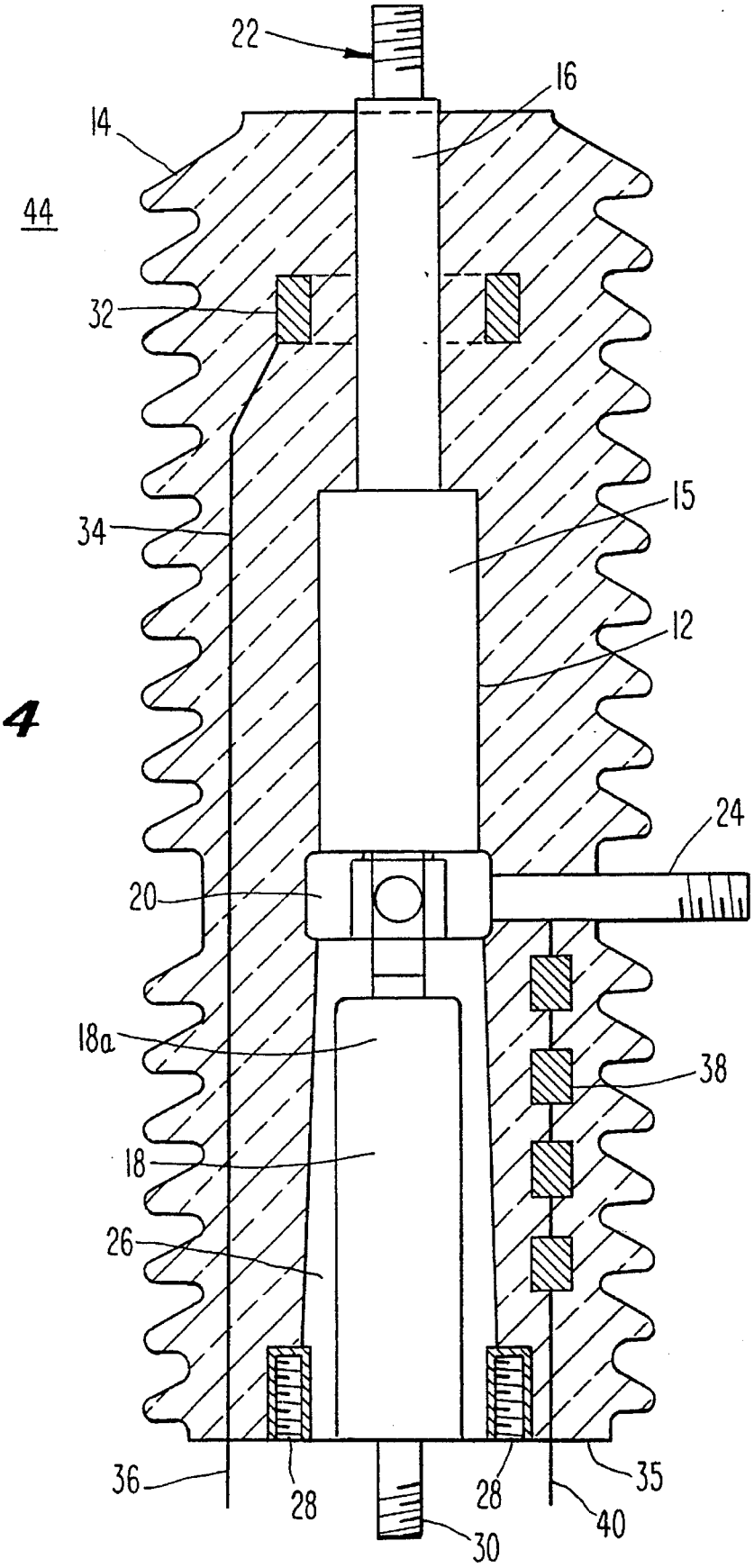
FIG. 4 is a sectional view of an interrupter assembly in accordance with a fourth embodiment of the present invention.

FIG. 4 illustrates an interrupter assembly 44 in accordance with a fourth embodiment of the present invention. As in the interrupter assembly 42 of FIG. 3, a first condition sensing device 32 is embedded in the solid dielectric body proximate the stationary terminal rod 16. In the fourth embodiment, however, a second condition sensing device 38 is embedded in the solid dielectric body 14 proximate the lower contact terminal 24. In this embodiment, the first condition sensing device 32 comprises a current sensor, and the second condition sensing device comprises a voltage sensor. As shown, the voltage sensor 38 is coupled directly to the lower contact terminal 24 and has a lead 40 that emerges from the bottom end 35 of the solid dielectric body 14. Any suitable voltage sensor may be employed, such as a capacitive divider or a resistive divider.

As the foregoing illustrates, the present invention is directed to an interrupter assembly comprising an interrupter switch and at least one condition sensing device, wherein both the interrupter switch and the current sensing device are embedded in a solid dielectric material. With the interrupter assembly of the present invention, the overall size of electrical equipment incorporating such assemblies can be reduced, since the use of a solid dielectric allows multiple interrupter assemblies to be spaced in close proximity. Moreover, use of a solid dielectric material eliminates the need for an insulating oil or gas. By incorporating a current and/or voltage sensing device in the solid dielectric, the need to mount these devices separately or provide additional insulation is also eliminated.

It is understood that the present invention may be embodied in other specific forms without departing from the spirit or essential attributes thereof. For example, condition sensing devices other than current and/or voltage sensors may be embedded in the solid dielectric body of the assembly. Additionally, the condition sensing devices may be positioned within the solid dielectric body at positions other than those illustrated in FIGS. 1–4. Accordingly, reference should be made to the appended claims, rather than to the foregoing specification, as indicating the scope of the invention.

What is claimed is:

1. An interrupter assembly comprising an interrupter switch and at least one condition sensing device operatively coupled to the interrupter switch for sensing a condition of a circuit to which the interrupter assembly is connected, wherein the interrupter switch and said at least one condition sensing device are each embedded within a solid dielectric material said interrupter switch being embedded within a first portion of said solid dielectric material and said at least one condition sensing device being embedded in a second portion of said solid dielectric material, said interrupter switch having a stationary terminal rod and a movable terminal rod, said movable terminal rod extending at least partially through a substantially cylindrical opening in said second portion of said solid dielectric material, a contact terminal disposed at least partially within said second portion of said solid dielectric material, and a current transfer assembly electrically coupled to the movable terminal rod and to the contact terminal to provide a transfer of current from the movable terminal rod to the contact terminal.

2. The interrupter assembly of claim 1 wherein the solid dielectric material is one of a polymer concrete, an epoxy-concrete and an epoxy resin.

3. The interrupter assembly of claim 1 wherein said at least one condition sensing device comprises a current sensor.

4. The interrupter assembly of claim 1 wherein said at least one condition sensing device comprises a voltage sensor.

5. The interrupter assembly of claim 1 wherein said at least one condition sensing device comprises a current sensor and a voltage sensor.

6. The interrupter assembly of claim 1 wherein the interrupter switch comprises a vacuum interrupter switch.

7. The interrupter assembly of claim 1 wherein the interrupter switch and said at least one condition sensing device are each embedded within a single body of solid dielectric material.

8. The interrupter assembly of claim 7 wherein said at least one condition sensing device comprises a current sensor embedded in the body of solid dielectric material proximate the stationary terminal rod of the interrupter switch.

9. The interrupter assembly of claim 8 wherein the current sensor comprises a ring-type current transformer having a substantially annular core, and wherein the current transformer is disposed within the body of solid dielectric material such that the stationary terminal rod extends substantially axially through the center of the annular core.

10. The interrupter assembly of claim 7 wherein said at least one condition sensing device comprises a current sensor embedded in the body of solid dielectric material proximate said contact terminal.

11. The interrupter assembly of claim 7 wherein said at least one condition sensing device comprises a current sensor and a voltage sensor, and wherein the current sensor is embedded in the body of solid dielectric material proximate the stationary terminal rod of the interrupter switch and the voltage sensor is embedded in the body of solid dielectric material so as to be coupled to said contact terminal.

12. The interrupter assembly of claim 1 wherein said first portion of said solid dielectric material comprises a first body of solid dielectric material and said second portion of said solid dielectric material comprises a second body of solid dielectric material, the interrupter switch being embedded within said first body of solid dielectric material, and said at least one condition sensing device being embedded within said second body of solid dielectric material, the first body of solid dielectric material being joined to the second body of solid dielectric material.

13. The interrupter assembly of claim 12 wherein the condition sensing device comprises a ring-type current transformer having a substantially annular core, and wherein the current transformer is disposed within the second body of solid dielectric material such that the contact terminal extends substantially axially through the center of the annular core.

14. An interrupter assembly comprising an interrupter switch and at least one condition sensing device operatively coupled to the interrupter switch for sensing a condition of a circuit to which the interrupter assembly is connected, wherein the interrupter switch and said at least one condition sensing device are each embedded within a solid dielectric material, said interrupter switch being embedded within an upper portion of said solid dielectric material and the condition sensing device being embedded in the upper portion of said solid dielectric material, said interrupter switch having a movable terminal rod extending at least partially through a substantially cylindrical opening in said lower portion of said solid dielectric material, a contact terminal disposed at least partially within said lower portion of said solid dielectric material, and a current transfer assembly electrically coupled to the movable terminal rod and to the contact terminal to provide a transfer of current from the movable terminal rod to the contact terminal.

* * * * *